US005607155A

United States Patent [19]

Campbell

[11] Patent Number: 5,607,155

[45] Date of Patent: Mar. 4, 1997

[54] PIVOTED PLAYER-TILTABLE GAMES TABLE

[76] Inventor: Neil D. Campbell, 4 Heybridge Lane, Christchurch, New Zealand

[21] Appl. No.: 436,221

[22] PCT Filed: Nov. 17, 1993

[86] PCT No.: PCT/NZ93/00114

§ 371 Date: May 16, 1995

§ 102(e) Date: May 16, 1995

[87] PCT Pub. No.: WO94/11072

PCT Pub. Date: May 26, 1994

[30] Foreign Application Priority Data

Nov. 17, 1992 [NZ] New Zealand ..... 245156

[51] Int. Cl.[6] ..... A63F 7/38

[52] U.S. Cl. ..... 273/110; 273/113; 273/115; 273/118 R; 273/123 R; 273/125 R; 273/125 A; 273/123 A

[58] Field of Search ..... 273/110, 111–118, 273/119–125

[56] References Cited

U.S. PATENT DOCUMENTS

| | | | |
|---|---|---|---|
| 3,617,061 | 11/1971 | Goldfarb et al. | 273/110 |
| 3,931,972 | 1/1976 | Fabian | 273/110 |
| 4,256,307 | 3/1981 | Brooks | 273/118 A |
| 4,448,416 | 5/1984 | Belter | 273/110 |
| 4,537,402 | 8/1985 | Prather, Jr. | 273/116 |
| 4,693,476 | 9/1987 | Talamantez, Jr. | 273/110 |
| 5,066,014 | 11/1991 | Dobson | 273/110 |

FOREIGN PATENT DOCUMENTS

| | | | |
|---|---|---|---|
| 1241430 | 8/1960 | France | 273/110 |
| 2584302 | 7/1985 | France . | |
| 9816 | 10/1879 | Germany | 273/110 |
| 3001768 | 7/1981 | Germany . | |
| 603169 | 3/1960 | Italy | 273/110 |
| 6605498 | 10/1967 | Netherlands | 273/110 |
| 322127 | 11/1929 | United Kingdom . | |
| 2040696 | 9/1980 | United Kingdom . | |

*Primary Examiner*—Benjamin H. Layno
*Attorney, Agent, or Firm*—Brooks & Kushman P.C.

[57] ABSTRACT

This invention comprises a games apparatus on which a game involving strength, skill and agility is playable by two or more opposing players who, in playing the game, must struggle against one another as they attempt to score points by directing a playing piece on a playing field into a designated scoring zone or zones. The apparatus comprises a playing field, on which a playing piece is movable, incorporating one or more scoring zones per player, together with one or more handles per player extending outwardly of the playing field manipulable to cause the playing field to be tilted from the horizontal, characterized in that the playing field is tiltably mounted on a pedestal, which pedestal is adapted to be fixedly mounted to a base at least during use of the games apparatus, the base being configured and arranged to, in play, carry substantially the entire weight of the players and to enable all the players to each exert up to their full strength in attempting to achieve tilting of the playing field without there being substantial risk of altering the relative orientation of the pedestal and the base.

20 Claims, 3 Drawing Sheets

PIVOTED PLAYER-TILTABLE GAMES TABLE

TECHNICAL FIELD

This invention relates to a games apparatus having a playing surface on which a playing piece is movable and, more particularly, to a games apparatus on which opposing players or teams can pit their strength, skill and agility against one another to effect tilting of the playing surface, and thus movement of the playing piece.

BACKGROUND ART

Various forms of games apparatus have already been proposed having a playing surface tiltable by the players to cause a playing piece to move thereon.

British Patent Specification 322127, for example, discloses a games apparatus in which a playing surface supported entirely by the players is competitively tilted to cause a ball or a sliding object to move over the playing surface. The games apparatus is forked at opposite ends to form handles with which the players support the playing surface. The playing surface is rectangular, circular or some other shape, and is provided with apertures through which the ball may pass into pockets.

By way of further example, U.S. Pat. No. 3,617,061 details a games apparatus for competitive play by two or more participants comprising a platform having an upper playing surface. The playing surface has a central discharge opening and supports one or more mobile playing pieces such as marbles for movement over the playing surface. The platform is connected at its edge to two or more handle means which are spaced apart around the platform and are intended to be firmly grasped by players who struggle or wrestle against one another to attempt to manipulate the platform to cause or prevent the marble from falling into the opening.

The device also includes means connected to the underside of the platform below the opening to receive discharged marbles, and adapted to support the platform in a position elevated above a support surface such as a table while affording ready manipulation of the platform.

U.S. Pat. No. 3,931,972 discusses another alternative design of games apparatus. The apparatus includes an open top housing assembly with a universally tiltable open top insert assembly mounted therein. Upright guides within the housing assembly guide vertically adjustable lifters with handles which project laterally outward through slots in the end walls of the housing assembly. Said lifters supportably engage the undersurface of the insert assembly. Selective vertical manual movements of one or more lifters are adapted to variably adjust the insert assembly to any resultant angle relative to a horizontal plane throughout 360° selectively. Game board indicia is provided upon the insert assembly bottom wall to receive a series of variably spaced targets or obstacles. A ball initially disposed on the indicia is movable thereover relative to the insert assembly walls in various directions depending upon the resultant tilt of the insert assembly so as to strike or not strike said targets or obstacles.

It has been noted that teenagers and young adults have large amounts of what could be described as "excess" energy. They also enjoy games and contests which involve strength, skill and agility None of the prior art provide a games apparatus for satisfactorily harnessing that excess energy in a controlled way in a games apparatus of the kind identified.

In particular, in all of the games apparatus considered above, if one player, or team attempts to direct the playing piece to move towards the opposing player orteams by applying a lifting force to their end it is very easy for the opposing playing or team to counter that maneouver simply by lifting their own end also.

The games apparatus described in U.S. Pat. No. 3,617,061 perhaps comes closest to meeting this goal, in that should a player or team attempt to tilt the playing surface to one side or the other, or to tilt the playing surface downwards at their side that movement can be opposed by the other player or team applying a force in direct opposition. Thus, the contest as to which way the playing surface will tilt becomes one of strength. However, as noted above, should a player or team wish to tilt the playing surface towards the opposing player or team that movement can be countered by applying a similar force, resulting in the playing surface remaining level but being lifted off the ground. Moreover, sudden movements produced by rapid changes in force application are likely to de-stabilise the apparatus and disrupt the game.

It is an object of the present invention to provide a games apparatus in which all movements of the playing surface caused by one player or team can be directly opposed by the opposing team or player through the application of a force in the same direction, the resultant tilting of the playing surface being determined by a contest of strength between the players or teams.

SUMMARY OF THE INVENTION

In a broad aspect of this invention there is provided games apparatus on which a game involving strength, skill and agility is playable by two or more opposing players or teams who, in playing the game, must struggle against one another as they attempt to score points by directing a playing piece on a playing field into a designated scoring zone or zones, the apparatus comprising:

a said playing field, on which a said playing piece is movable, incorporating one or more said scoring zones per player or team;

together with one or more handles per player or team extending outwardly of the playing field manipulable to cause the playing field to be tilted from the horizontal;

characterised in that the playing field is tiltably mounted on a pedestal, which pedestal is adapted to be fixedly mounted to a base at least during use of the games apparatus, the base being configured and arranged to, in play, carry substantially the entire weight of the players or teams and to enable all the players to each exert up to their full strength in attempting to achieve tilting of the playing field without there being substantial risk of altering the relative orientation of the pedestal and the base.

Preferably the playing field is mounted to the pedestal via a ball and socket joint. Alternatively, mounting may be by way of a resilient spring connection, such as a spring steel or rubber member.

Desirably the games apparatus includes a restoring means to return the disposition of the playing field to a horizontal plane when no tilting force is being applied by the players.

Advantageously the games apparatus includes limiting means to limit the angle of tilt of the playing field relative to the pedestal to a preset maximum. Optionally the limiting means can also limit rotation of the playing field about the pedestal to a preset maximum.

Preferably the base comprises a platform adapted to be supported on a support surface, such as the ground or a floor.

Alternatively the base can be the ground or floor itself, with the lower end of the pedestal fixed mounted therein, either permanently by concrete, welding or the like, or semi-permanently by, for example, bolts. This kind of arrangement is particularly suited to games apparatus sited in shopping malls, arcades, etc.

Desirably the playing field is square or rectangular, however, any shape may be used. Preferably where there are intended to be more than two players or teams the players are equispaced around the playing field.

Advantageously the handles can extend circumferentially around the playing field and can be gripped at substantially any point.

Preferably the scoring zones of each player are located substantially opposite that player across the playing field. However, the socring zones can be located at any position which encourages competitive play. Conveniently each player may have one scoring zone which can only be approached by negotiating one or more obstacles.

Desirably each scoring zone is defined by an aperture in the playing field. A pocket can be formed below the aperture, or optionally, the apertures may feed to playing piece collection tubes to facilitate controlled discharge of playing pieces for subsequent play.

Preferably the playing piece comprises a ball or puck.

Advantageously the games apparatus incorporates a mechanical, electric or electronic coin-freed playing piece release mechanism to release a playing piece for play.

Preferably the coin-freed mechanism releases the playing piece directly to the playing field.

Desirably the playing field is enclosed by a laminated glass or clear plastics cover.

Conveniently, activation of the coin-free mechanism causes the apertures defining the scoring zones to be closed off for a predetermined period to enable players to familiarise themselves with the games apparatus and each other as opponents.

BRIEF DESCRIPTION OF THE DRAWINGS

A presently preferred embodiment of the invention will now be described, by way of example only, with reference to the accompanying drawings, in which.

BEST MODE FOR CARRYING OUT THE INVENTION

Figure 1:
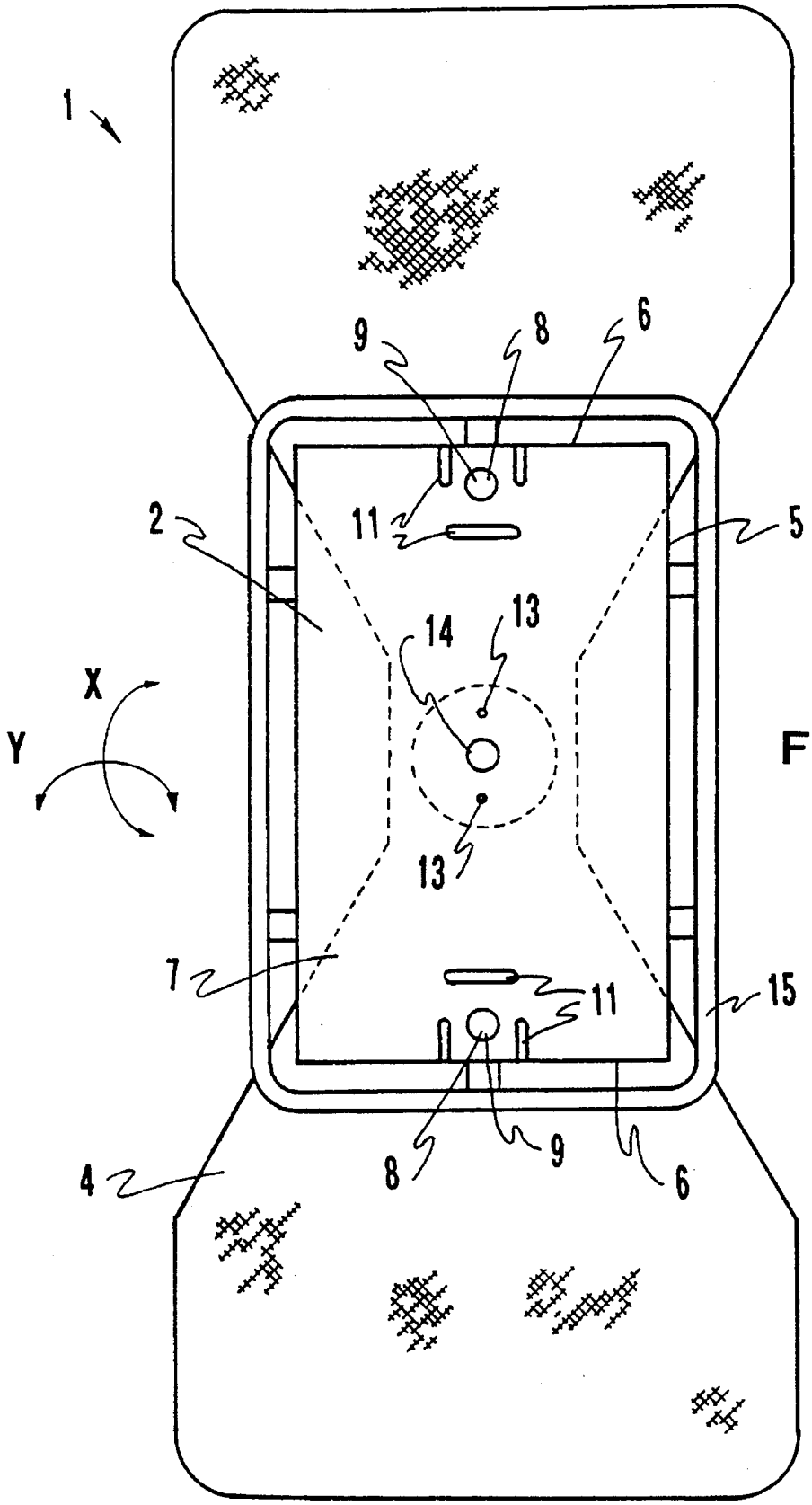
FIG. 1 illustrates a plan view of a games apparatus according to the present invention.
Figure 3:
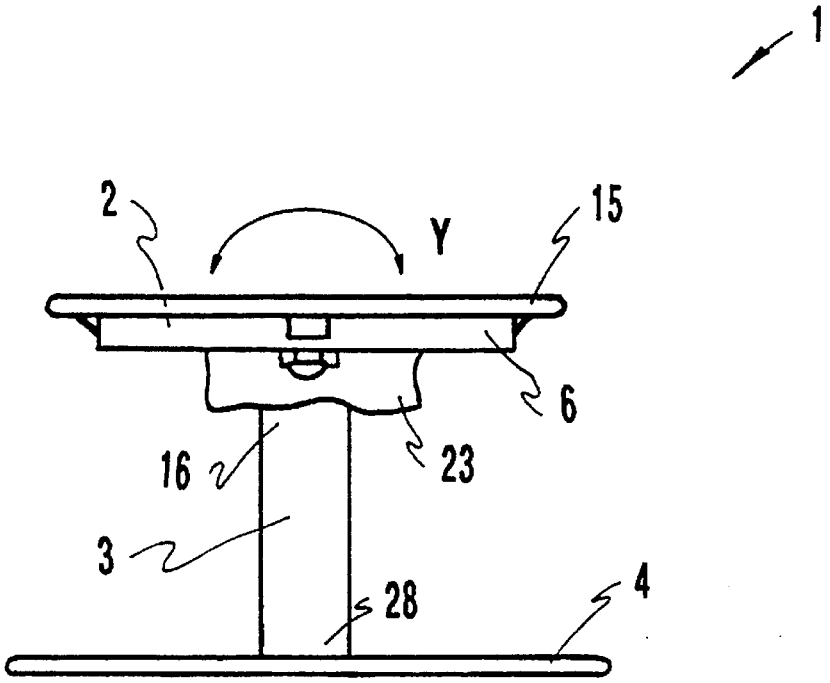
FIG. 3 illustrates an end elevation of the games apparatus of FIG. 1; and, FIG. 4 illustrates a partial side elevation cross section of the games apparatus of FIG. 1.

As shown in the drawings, the invention provides a games apparatus, as generally indicated at 1, comprising a playing field 2 mounted on a pedestal 3 which in turn is mounted on a base platform 4.

Figure 4:
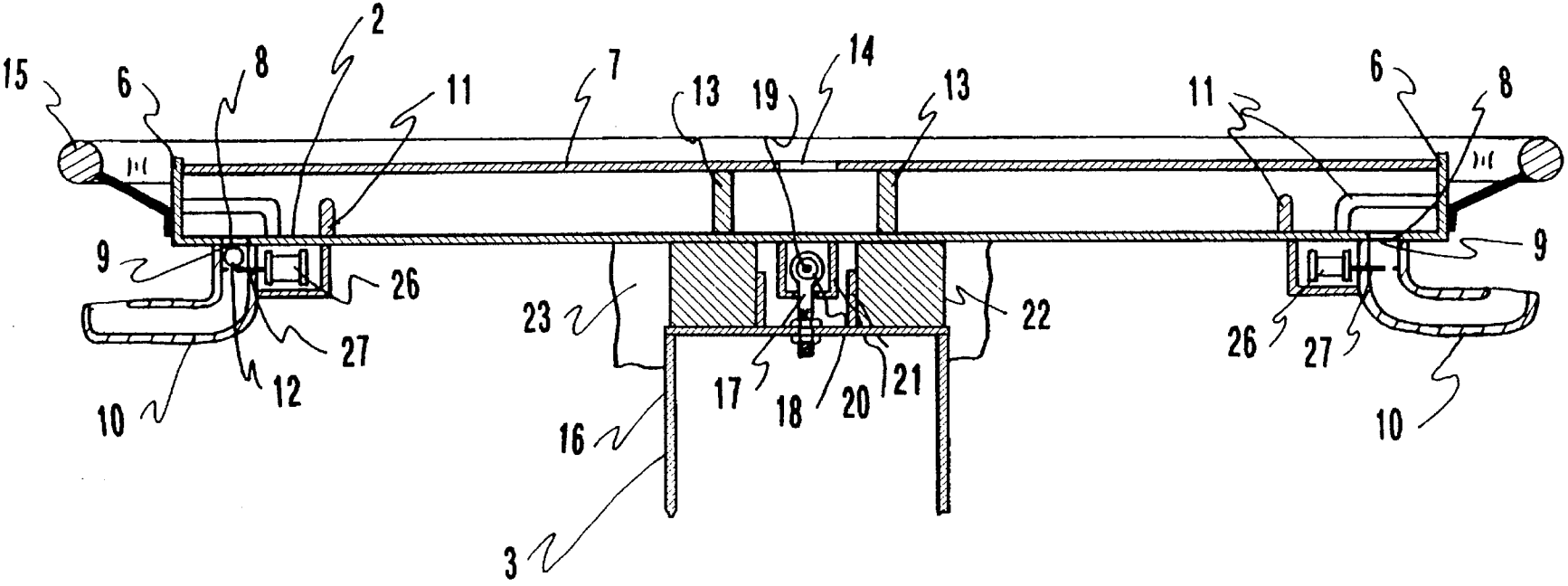

The playing field 2 is substantially rectangular in shape, having upstanding sides 5, upstanding ends 6, and a clear plastics cover 7. Located centrally at both ends of the playing field 2 are scoring zones 8. Each scoring zone 8 is defined by an aperture 9 which feeds into a separate chute 10. The scoring zones 8 are each guarded by fences 11 which ensure that to enter a scoring zone 8 the ball 12 (shown in FIG. 4) must approach from particular directions only. Various other obstacles 13 may also be in place on the playing field 2. Alternatively, the ball 12 could be admitted via a chute (not shown) extending from a side 5 which opens out into the playing field 2.

A central aperture 14, sized to permit passage of the ball 12, is provided in the cover 7 to enable the ball 2 to be admitted to the playing field 2.

Mounted outwardly of and circumscribing the playing 2 is a handle 15.

The playing field 2 is connected to the upper end 16 of the pedestal 3 by way of a ball and socket type joint. In this regard, a rod end 17 extends vertically upwardly from the upper end 16 of the pedestal 3. The ball 18 forming part of the rod end 17 has an aperture therethrough in which a pin 19 is received. The ends of the pin 19 are welded to a box 20 which in turn is connected to the underside of the playing field 2. Outer walls 21 extend upwardly from the upper end 16 of the pedestal 3, surrounding the rod end 17 and part of the depending box 20. The walls 21 are spaced outwardly of the box 20 to allow a degree of relative movement to enable the playing field 2 to be tilted and twisted in the directions X and Y shown in the figures, but between limits. Surrounding the walls 21 and occupying the space between the underside of the playing field 2 and upper end 16 of the pedestal 3 is a foam ring 22. The function of the foam ring 22 is to return the playing field 2 to the horizontal once all forces applied by the players are removed. Finally, outwardly of the foam ring 22 depending from the underside of the playing field 2 is a protective fabric skirt 23.

Figure 2:
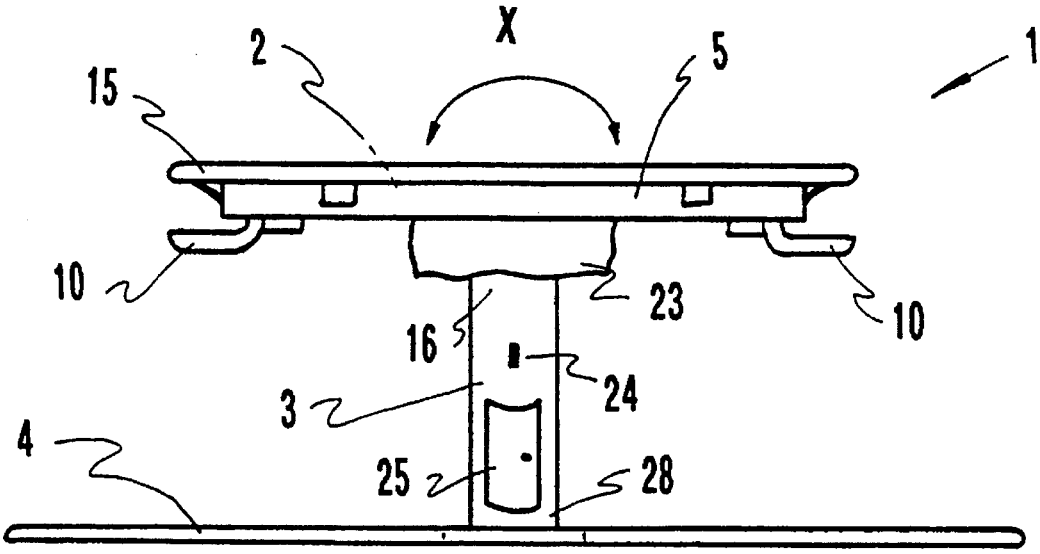
FIG. 2 illustrates a side elevation of the games apparatus of FIG. 1.

Housed within the pedestal 3, which is approximately one metre high, is a coin-freed mechanism 24 (partially shown in FIG. 2). A trap door 25 is also provided to enable recovery of coins inserted into the coin-freed mechanism 24.

The coin-freed mechanism 24 activates two solenoids 26 one each of which is mounted and housed beneath the playing field 2 adjacent a chute 10. Each solenoid 26 has a reciprocatable rod 27 which, in the extended position, projects into the chute 10 preventing the ball 12 from dropping down. Once a correct coin is inserted into the coin-freed mechanism 24 the solenoid 26 is activated to withdraw the rod 27 and allow the ball 12 to drop. The chute 10 is L-shaped, having a lower end which forms a cup. The ball 12 drops down into the cup portion from where it can be retrieved for insertion into the central aperture 14 above the playing field 2, and play commenced.

The lower end 28 of the pedestal 3 is connected to the base platform 4, preferably by way of a bolted joint.

The base platform 4 is sized and shaped to allow the players to stand thereon while the games apparatus 1 is in use. Because of the physical nature of the game the upper surface of the base platform 4 is preferably skid resistance.

Use of the games apparatus 1 will be described as a competition between two opposing players, however, it is possible for two teams of two or even three people to play against each other.

The ball 12 is first released by inserting a correct coin in the coin-freed mechanism 24. Then the opposing players position themselves at opposite ends of the playing field 12. They each take a firm grip of a section of the handle 15 closest to them. A third person drops the ball 12 in through the aperture 14 onto the playing field 2 to commence play.

With the ball 12 in play the players struggle and wrestle against each other as they attempt to manipulate the playing field 2 to an angle which causes the ball 12 to roll in the direction they wish.

In this regard, each player trys to direct the ball 12 into the scoring zone 8 at the end of the playing field 2 opposite them and prevent the other player from doing likewise, in the process the ball 12 is manouevred around the various obstacles 13 and through a path created between the fences 11.

The game finishes when one of the players is successful in directing the ball 12 into their particular scoring zone 8.

It will be appreciated that games played on the games apparatus 1 are very physical, in that the opposing players are directing pitting their strength against each other. This makes for an exciting contest both for the players and spectators.

It is envisaged that the games apparatus 1 could be used for fundraising purposes as, while heavy, it can be relatively easily transported from place to place in a station wagon or utility vehicle.

The possibility of competitions and television game shows revolving around the games apparatus 1 are contemplated, although for team competition some modification may be required.

Further, the sides 5, ends 6 and playing field 2 itself may be utilised to carry advertising messages or the like.

Additional advantages of the present invention will become apparent to those skilled in the art after considering the principles in particular form as discussed and illustrated.

Accordingly, it will be appreciated that changes may be made to the above described embodiment of the invention without departing from the principles taught herein.

Finally, it will be understood that this invention is not limited to the particular embodiment described or illustrated, but is intended to cover all alterations, additions or modifications which are within the scope of the appended claims.

I claim:

1. A games apparatus on which a game involving strength, skill and agility is playable by two or more opposing players or teams who, in playing the game, must struggle against one another as they attempt to score points by directing a playing piece on a playing field into a designated scoring zone or zones, the apparatus comprising:

a said playing field, on which a said playing piece is movable, incorporating one or more said scoring zones per player or team;

together with one or more handles per player or team extending outwardly of the playing field manipulable to cause the playing field to be tilted from the horizontal;

characterized in that the playing field is tiltably mounted on a pedestal, which pedestal is adapted to be fixedly mounted to a base at least during use of the games apparatus, the base being configured and arranged to, in play, support substantially the entire weight of the players or teams and to enable all the players to each exert up to their full strength in attempting to achieve tilting of the playing field without there being substantial risk of altering the relative orientation of the pedestal and the base.

2. Apparatus according to claim 1 wherein the playing field is mounted to the pedestal via a ball and socket joint or by way of a resilient spring connection.

3. Apparatus according to claim 1 wherein the games apparatus includes a restoring means to return the disposition of the playing field to a horizontal plane when no tilting force is being applied by the players.

4. Apparatus according to claim 3 wherein the games apparatus includes limiting means to limit the angle of tilt of the playing field relative to the pedestal to a preset maximum.

5. Apparatus according to claim 4 wherein the limiting means can limit rotation of the playing field about the pedestal to a preset maximum.

6. Apparatus according to claim 1 wherein the base comprises either a platform adapted to be supported on a support surface, or the ground or floor with the lower end of the pedestal fixedly mounted either permanently or semi-permanently. in the said ground or floor.

7. Apparatus according to claim 6 wherein the scoring zones of each player or team are located substantially opposite that player or team across the playing field.

8. Apparatus according to claim 1 wherein the playing field is square or rectangular.

9. Apparatus according to claim 1 such that where there are intended to be more than two players, or teams, the handle, or handles, per player, or team, are equispaced around the playing field.

10. Apparatus according to claim 1 wherein the handles extend circumferentially around the playing field and can be gripped at substantially any point.

11. Apparatus according to claim 1 wherein the scoring zones of each player or team are located substantially opposite that player or team across the playing field.

12. Apparatus according to claim 1 wherein each player or team has a scoring zone which can only be approached by negotiating one or more obstacles.

13. Apparatus according to claim 12 wherein each scoring zone is defined by an aperture in the playing field.

14. Apparatus according to claim 1 wherein each scoring zone is defined by an aperture in the playing field.

15. Apparatus according to claim 14 wherein the apertures feed to playing piece collection tubes to facilitate controlled discharge of playing pieces for subsequent play.

16. Apparatus according to claim 15. wherein the games apparatus incorporates a mechanical, electric or electronic coin-freed playing piece release mechanism to release a playing piece for play.

17. Apparatus according to claim 16 wherein the coin-freed mechanism releases the playing piece directly to the playing field.

18. Apparatus according to claim 16 wherein activation of the coin-freed mechanism causes the apertures defining the scoring zones to be closed off for a predetermined period to enable players to familiarise themselves with the games apparatus and each other as opponents.

19. Apparatus according to claim 1 wherein the playing piece comprises a ball or puck.

20. Apparatus according to claim 1 wherein the playing field is enclosed by laminated glass or clear plastics cover.

* * * * *